United States Patent [19]

Aziz et al.

[11] Patent Number: 4,622,796

[45] Date of Patent: Nov. 18, 1986

[54] STRUCTURAL CONNECTION FOR CAVITY WALL CONSTRUCTION

[76] Inventors: Edward M. Aziz, 203 Base Line Road East, London, Ontario, Canada; Robert Gulow, 4704 Van Kleeck Dr., New Smyrna Beach, Fla. 32009

[21] Appl. No.: 569,612

[22] Filed: Jan. 10, 1984

Related U.S. Application Data

[63] Continuation of Ser. No. 335,622, Dec. 30, 1981, abandoned.

[51] Int. Cl.[4] ..... E04C 1/04

[52] U.S. Cl. ..... 52/747; 52/379; 52/404; 52/562; 52/710

[58] Field of Search ..... 52/586, 588, 589, 590, 52/591, 421, 422, 620, 562, 563, 564, 565, 710, 379, 410, 428, 426, 513, 378, 404

[56] References Cited

U.S. PATENT DOCUMENTS

| | | | |
|---|---|---|---|
| Re. 15,979 | 1/1925 | Schaefer | 52/710 |
| 1,079,115 | 11/1913 | Denison | 52/428 |
| 1,567,085 | 12/1925 | Rowland | 52/586 |
| 1,725,200 | 8/1929 | Lampert | 52/379 |
| 1,832,231 | 11/1931 | Menninger | 52/378 |
| 1,936,223 | 11/1933 | Aubery | 52/562 |
| 2,115,137 | 4/1938 | Bosco | 52/710 |
| 2,160,792 | 5/1939 | Cantwell | 52/513 |
| 3,300,939 | 1/1967 | Brynjolfsson et al. | 52/713 |
| 3,309,830 | 3/1967 | Fitzgerald | 52/428 |
| 3,341,998 | 9/1967 | Lucas | 52/379 |
| 3,559,358 | 2/1971 | Lohse et al. | 52/513 |
| 3,999,349 | 12/1976 | Miele et al. | 52/404 |
| 4,194,337 | 3/1980 | Fischer | 52/428 |
| 4,206,577 | 6/1980 | Moriez et al. | 52/506 |

FOREIGN PATENT DOCUMENTS

| | | | |
|---|---|---|---|
| 2001452 | 7/1972 | Fed. Rep. of Germany | 52/426 |
| 324451 | 1/1930 | United Kingdom | 52/710 |
| 989285 | 4/1965 | United Kingdom | 52/212 |

*Primary Examiner*—John E. Murtagh
*Assistant Examiner*—Andrew Joseph Rudy
*Attorney, Agent, or Firm*—Brian W. Gray

[57] ABSTRACT

One common type of masonry wall is called a cavity wall which is composed of two wythes. This invention relates to a system for structurally connecting the two wythes together by the use of a mortise and tenon arrangement and for a particular type of connector having a flared tenon end and another end adapted for placement in the mortar joint of a wythe.

2 Claims, 5 Drawing Figures

STRUCTURAL CONNECTION FOR CAVITY WALL CONSTRUCTION

This application is a continuation of application Ser. No. 06/335,622 originally filed Dec. 30, 1981, now abandoned, entitled STRUCTURAL CONNECTION FOR CAVITY WALL CONSTRUCTION in the name of Edward M. Aziz and Robert A. Gulow and corresponding to Canadian application Ser. No. 367,864.

This invention relates to the field of masonry wall construction. Present building techniques often employ masonry bearing walls. These walls are commonly constructed of two separate wythes with a space between. The space or cavity is used to place insulation and to allow water to drain from the wall. One wythe is usually an exterior layer of brick and the other wythe is usually an interior layer of concrete block. In true cavity wall construction both wythes may be load bearing and it is essential that they be structurally connected together by a strong, dependable and easily installed system.

In the prior art, the wythes have been connected together by metal pieces cemented into the mortar joints of the wythe coursing. The crudest arrangement is simply a metal tie strip which must be bent to meet the coursing of each wythe. This strip provides acceptable results where the wythe coursing matches. However, although attempts have been made to standardize the heights of individual masonry units, it often happens that the coursing of one wythe does not line up with the coursing of the other because the two wythes may be started at different levels in the building foundation or because of interruptions due to architectural details, such as windows or because the units are not designed to be compatible. In this case, the metal tie strip is undesirable because it is important for the metal tie to lie horizontally in the mortar joint to create a strong connection and to minimize interference with the masonry construction. With this type of connection there is also the inconvenience and wasted time associated with bending the ties.

Other connector types have been developed such as that described in Canadian Pat. No. 745,400 issued Nov. 1, 1966 to Dur-O-Wal National Inc. These ties typically have two units one of which lies horizontally in the mortar joint of one wythe, and the other of which lies horizontally in the mortar joint of the other wythe. Adjustable means are provided to link the two units to compensate for differences in coursing. One such means is the pintle and eye construction of the Dur-O-Wal (trade mark) system described in Canadian Pat. No. 745,400 previously mentioned or the Dur-O-Eye (trade mark) system described in U.S. Pat. No. 3,300,939 issued Jan. 31, 1967. However these systems lose strength rapidly where there are any substantial differences in the elevation of the coursings (called eccentricity). Thus at an eccentricity or coursing difference of 1.5 inches, the Dur-O-Wal (trade mark) system will have an ultimate pull-out strength of only about 80 lbs. In addition most of these systems are limited in the amount of eccentricity that they will allow, and there is always a danger that the pintles installed in one wythe will slip out of the eyes installed in the other wythe, when the eccentricity is large.

Modern construction in cavity walls requires a connection with relatively strong tensile and compressive capacity, and the prior art connections and ties are not uniformly satisfactory where differences in eccentricity exist. It is desirable that the wythes be connected so that they move as a structural unit and that the structural connective force be positive and predictable and not variable with the amount of eccentricity or the manner in which the tie or connector is bent.

A structural connection is one which is designed to and is capable of transferring loads or forces between two or more members, in this instance, between wythes of masonry.

The present invention seeks to provide a readily adjustable structural connection which overcomes some of the problems of those ties which are placed in the mortar joints of both wythes by placing the connector in a vertical mortise in the masonry unit of one wythe and aligning the other end in the mortar joint of the other wythe.

This invention, in one of its aspects, involves a change to the masonry units used in building one of the wythes, usually the interior wythe. The masonry unit, which is normally concrete block, has a vertical slot or mortise in it. One wythe is built of a sufficient number of these mortised masonry units to allow sufficient places for the insertion of connectors. A connector is provided with a flared tenon end which is adapted for insertion into the mortise where it is substantially freely movable the vertical height of the masonry unit.

One wythe can be built with mortised masonry units to enclose a building quickly, an advantage in winter. The flared end of the metal connectors can then be inserted into the mortises when and where needed during the building of the second, usually exterior wythe and moved vertically to the correct position to match the coursing of the second wythe where it is secured into the mortar joint of the second wythe. Thus the invention in one aspect seeks to provide a structural connection which avoids the problems associated with connectors placed in the mortar joints of both wythes. The connector, which in other systems may stick out and be an annoyance during the building of the second wythe, with this invention need not be inserted into the first wythe as it is built.

Moreover since elaborate and strength-reducing designs do not have to be employed to match wythe coursing, the structural connection in one aspect of the invention seeks to provide a more positive and predictable structural connection between the wythes with regard to both tensile and compressive forces.

Thus the invention consists of a masonry unit and connector for use in connecting together the wythes of a cavity wall comprising a masonry unit having a vertical mortise for making one wythe of a cavity wall, a connector having a first flared tenon end and a second end, the first tenon end and mortise adapted to allow the tenon to engage the mortise and substantially restrain the connector from horizontal movement but to allow the tenon to move substantially freely vertically in the mortise, the second end adapted for placement in a second wythe mortar joint to prevent vertical movement of the connector.

Cavity wall for the purposes of this specification includes composite walls or any wall having two separate wythes of masonry unit construction without regard to the spacing between the wythes.

The invention will be understood more completely when considered with the following detailed description and the drawings in which.

Figure 1:
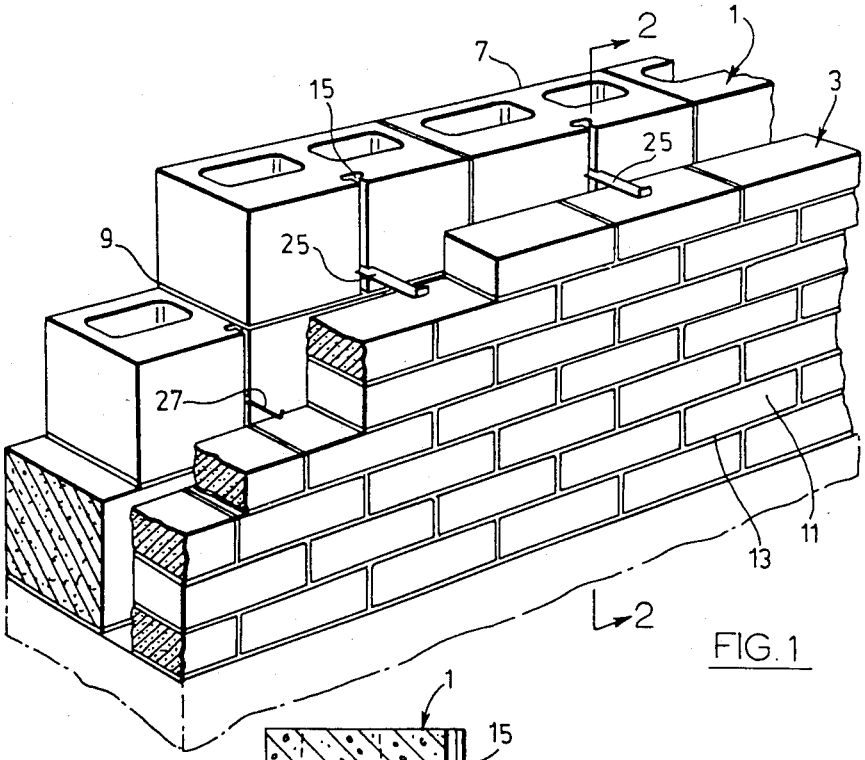
FIG. 1 is a perspective view of a partially completed cavity wall showing the mortised block and tenon connector of the present invention.
Figure 2:
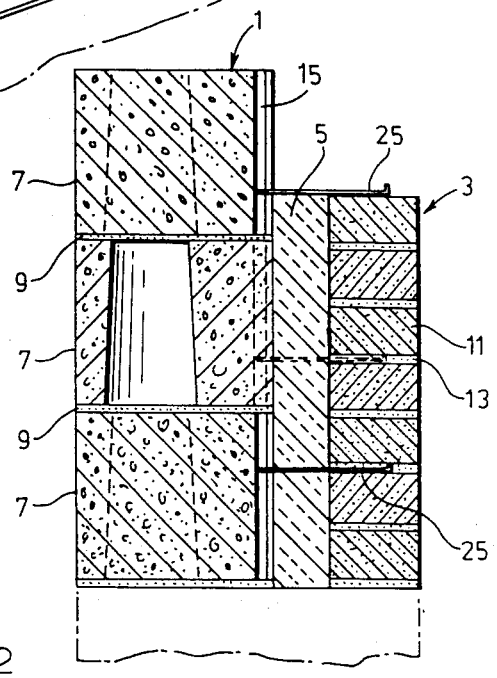
FIG. 2 is a section taken along the line 2—2 of FIG. 1.

In FIGS. 1 and 2 a typical cavity wall is shown. It will normally consist of a first wythe 1 and a second wythe 3. Insulation 5 may be provided between the two wythes. The first wythe will normally be the interior wythe and will be composed of individual masonry units such as concrete blocks 7, cemented together in the normal fashion to produce mortar joints 9. The second wythe 3 will be composed of individual masonry units such as bricks 11 also cemented together in the normal way to produce mortar joints 13.

Figure 5:
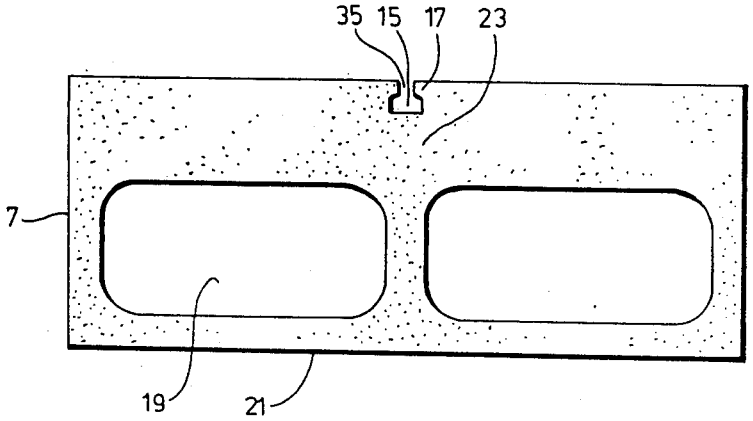
FIG. 5 is a plan view of a block containing a mortise according to one aspect of this invention.

The concrete blocks are manufactured with extruded mortises 15, usually roughly in the centre of one face of the block 7 as shown in FIG. 1 and FIG. 5.

As can be seen in FIGS. 1 and 5, the mortise 15 will run the height of block 7 and forms shoulders 17 in the block. These shoulders are relatively thick in order to give added strength to the mortise against a horizontal force pulling away from the face of the block since there is no permanent form to help distribute the load into the block. In the present embodiment, the distance between the front face of the block and the back of the mortise 15 is approximately one inch. If additional strength is needed, the mortise may be placed further into the block and the shoulder thickened. The cores 19 which are normally found in concrete blocks are disposed towards the rear face 21 of the block in order to provide more material at 23 to give added strength to the mortise. These holes are in actual fact slightly tapered in order to allow the block to be more easily stripped from the mould.

Figure 3:
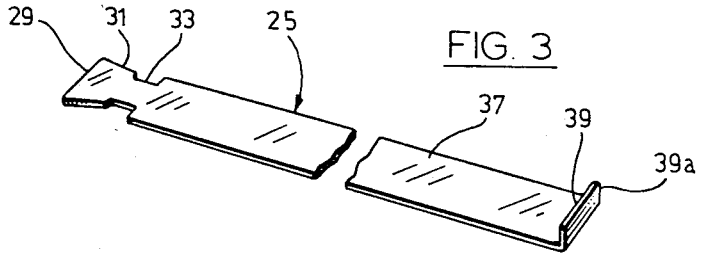
FIG. 3 is a perspective view of one type of connector used in the present invention.
Figure 4:
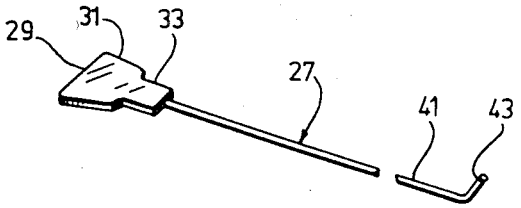
FIG. 4 is a perspective view of another type of connector used in the present invention.

A connector such as 25 or 27 is provided as shown in FIG. 3 or 4 which can fit into the mortise 15. Each connector has a flared dovetailed tenon end 29 which is made of sheet metal and is thus substantially flat.

In FIG. 3, connector 25 has a substantially flat sheet metal body 37 and an end 39 which terminates in a lip 39A. In FIG. 4, the connector 27 has a cylindrical rod body 41 and a bent end 43. The ends 39 or 43 are designed to be placed into the mortar joint of the second wythe as described below.

In operation, the blocks of the first wythe 1 are installed in the normal way with the mortises facing towards the second wythe 3. The first wythe 1 may be completely or partially finished before construction of the second wythe begins. It may be advantageous to finish the first wythe to enclose a space for interior construction during the winter months.

The second wythe is built in the normal way up to a height which requires connectors. Since it is a common Building Code requirement that connectors be placed not further apart than 18 inches vertically and 36 inches horizontally, the first connectors would normally be inserted when the coursing of the second wythe was 16 inches off the ground. Since the connector blocks shown are slightly less than 16 inches long and 8 inches high, it should not be a problem to space the connectors the recommended distance. Of course, connectors could be spaced further or closer if the building code and engineering specifications allow.

The connector 25 or 27 is inserted into the mortise 15 by turning the flared tenon end 31 to a vertical position and passing it through shoulders 17 into the mortise 15. The end 31 is then turned 90° to a horizontal position to span the mortise 15 and cause flared edges 31 to contact shoulders 17 and restrain the connector 25 or 27 from pulling out of the block. The neck 33 of the tenon end can fit in throat 35 formed by the shoulders 17. The flared tenon is thus free to move vertically in the mortise and generally not free to move horizontally. The connector is then moved vertically in the slot so that its other end lies horizontally on the mortar joint 13 of the second wythe 3.

The length of the connector is determined by the distance between the two wythes 1 and 3 which is normally determined by the amount of insulation required. This distance will normally be from 2 to 6 inches. Since it is desirable to have the connector lie across almost the complete width of the mortar joint of the second wythe as shown in FIG. 2, the length of the connector will normally be between 5 to 9 inches.

The connector 25 is made of a flat piece of sheet metal with an up-turned end 39A. The purpose of this end is to provide better grip in the mortar joint 13. The problem with connector 27 is that metal body 37 may create a relatively large hole in insulation 5 during its installation.

Rigid insulation 5 is normally placed onto the outer face of the first wythe. The connector 25 is punched through the rigid insulation and turned 90° to span the width of the mortise as previously described. The effect of the punching and turning is to create a relatively large hole in the insulation. Connector 27 seeks to overcome this problem by providing a cylindrical body 41 which does not enlarge the hole in the insulation when the connector is turned to span the width of the mortise. The bent rod end 43 ensures that sufficient surface area contacts the joint 13 to ensure that the connector is strongly secured in the joint. Connectors 25 and 27 are both shown by way of illustration in FIG. 1, but normally only one or the other would be used. Other configurations for the end lying in the mortar joint could easily be substituted.

After the connector has been placed on the mortar joint 13, the next coursing of masonry units is laid until the next level requiring a connector is reached.

It will be appreciated that once the end 39 or 43 has been embedded in the mortar joint 13, the connector 25 or 27 cannot normally move vertically nor rotate to allow the flared tenon end 29 to leave the mortise 15.

From tests with the dovetailed flared tenon end shown in FIGS. 3 and 4, it appears that the pull-out strength of the block is adequate along the total vertical height of the block although slightly greater at the centre of the block. It can be predicted from known material specifications that the compressive strength will meet structural building standards.

The first series of pull-out tests were made with blocks of average compressive strength (gross area) of 2,500 psi. Tests 1 through 5 averaged 940 lbs. and tests 6 through 10 averaged 896 lbs., both using 16 ga. flat connectors. Tests 11 to 20 gave lower values, using a 0.190 diameter wire which is not recommended.

The following is a summary of the pull-out tests carried out on the blocks with extruded dovetail mortises.

| Test No. | Position of Connector | Type of Connector 16 ga. | Pull-Out Force | Type of Failure |
|---|---|---|---|---|
| 1 | Centre of Block | Flat | 1160 lb. | Concrete |
| 2 | " | " | 1000 lb. | " |
| 3 | " | " | 870 lb. | " |
| 4 | " | " | 820 lb. | " |
| 5 | " | " | 860 lb. | " |
| | | Average pull-out force | 940 lb. | |
| 6 | 1" from edge | Flat | 1000 lb. | Concrete |
| 7 | " | " | 950 lb. | " |
| 8 | 1" from edge | Flat | 890 lb. | Concrete |
| 9 | " | " | 940 lb. | " |
| 10 | " | " | 700 lb. | " |
| | | Average pull-out force .190" dia. | 900 lb. | |
| 11 | 1" from edge | Wire | 620 lb. | Concrete |
| 12 | " | " | 480 lb. | " |
| 13 | " | " | 640 lb. | " |
| 14 | " | " | 460 lb. | " |
| 15 | " | " | 580 lb. | " |
| | | Average pull-out force .190" dia. | 560 lb. | |
| 16 | Centre of Block | Wire | 610 lb. | Concrete |
| 17 | " | " | 520 lb. | " |
| 18 | " | " | 780 lb. | " |
| 19 | - | " | 690 lb. | " |
| 20 | " | " | 320 lb. | " |
| | | Average pull-out force | 580 lb. | |

The second series of pull-out tests were made with blocks of average compressive strength (gross area) of 1,520 psi. The test results average a combined value of 532 lbs. for both flat connectors and revised wire connectors.

| | Pull-Out Force lbs. | |
|---|---|---|
| Wire Connectors - Centre of Block | | |
| 1 | 560 lbs. | Ave. = 530 lbs. |
| 2 | 600 lbs. | s = 72 |
| 3 | 518 lbs. | |
| 4 | 523 lbs. | |
| 5 | 580 lbs. | |
| 6 | 397 lbs. | |
| Wire Connectors - 1" from Edge | | |
| 1 | 543 lbs. | Ave. = 537 lbs. |
| 2 | 457 lbs. | s = 51 |
| 3 | 536 lbs. | |
| 4 | 548 lbs. | |
| 5 | 600 lbs. | |
| Flat Connectors - Centre of Block | | |
| 1 | 469 lbs.* | Ave. = 530 lbs. |
| 2 | 563 lbs. | s = 53 |
| 3 | 597 lbs. | |
| 4 | 486 lbs. | |
| 5 | 531 lbs. | |

-continued

| | Pull-Out Force lbs. | |
|---|---|---|
| Flat Connectors - 1" from Edge | | |
| 1 | 538 lbs. | Ave. = 530 lbs. |
| 2 | 642 lbs. | s = 78 |
| 3 | 434 lbs. | |
| 4 | 486 lbs. | |
| 5 | 555 lbs. | |

*Connector twisted & concrete failure

With but one exception of the total of 41 tests from both series, failure occurred by shearing of the concrete slot. The values given in the above tables are all ultimate (failure) loads. Applying the appropriate factors of safety, the working values would be as follows:

For the 2,500 psi. compressive strength blocks, test 1–10, 225 lbs.

For the 1,520 psi. compressive strength blocks, 135 lbs.

Greater strength could be achieved by a more deeply recessed mortise or by changes to the shape of the tenon end. While a particular embodiment has been described, it is understood that this is not intended to restrict the scope of the claims which follow.

We claim:

1. A method of cavity wall construction comprising the steps of:

(a) building a first interior wythe composed of a plurality of masonry blocks arranged in a plurality of courses, at least some of the masonry blocks each having at least one vertical mortise which is in a face of the masonry block and which is open only at said face;

(b) building a second wythe facing the vertical mortises of the first wythe to a level to receive a connector;

(c) placing insulation between the first and second sythes, either prior to or while building the second wythe;

(d) inserting a dovetailed tenon end of a connector through the insulation and into the mortise in one of the masonry blocks and turning the connector to engage said mortise to substantially prevent horizontal movement of the connector;

(e) moving the connector vertically in said mortise to a position horizontally level with the coursing of the second wythe;

(f) cementing a second end of the connector into the mortar joint of the second wythe to prevent vertical movement of the connector and to connect the first and second wythes together.

2. The method of claim 1, in which the tenon end and the second end of the connector are connected by a connecting portion of a straight cylindrical form and in which the second end has a portion radially extending from the connecting portion thereby to prevent rotation of the connector about the axis of the connecting portion when the second end is placed in the mortar joint of the second wythe.

* * * * *